US005406242A

United States Patent [19]

Klocinski et al.

[11] Patent Number: 5,406,242

[45] Date of Patent: Apr. 11, 1995

[54] IGNITION COIL

[75] Inventors: James J. Klocinski, Saline; Robert C. Bauman, Flat Rock, both of Mich.

[73] Assignee: Ford Motor Company, Dearborn, Mich.

[21] Appl. No.: 179,277

[22] Filed: Jan. 10, 1994

[51] Int. Cl.[6] ..... H01F 27/04

[52] U.S. Cl. ..... 336/107; 439/125; 439/126; 123/634

[58] Field of Search ..... 336/107, 105; 123/634; 439/125, 126, 129, 130; 174/84 R

[56] References Cited

U.S. PATENT DOCUMENTS

| | | | |
|---|---|---|---|
| 221,074 | 10/1879 | Knudson . | |
| 2,458,121 | 1/1949 | Waldron | 439/126 |
| 2,478,087 | 11/1945 | Bychinsky et al. | 315/57 |
| 2,625,579 | 1/1953 | Frazee | 439/126 X |
| 3,851,298 | 11/1974 | Sokolov | 339/276 A |
| 3,871,349 | 3/1975 | Hager | 123/169 EL |
| 4,035,751 | 7/1977 | Walthew | 336/83 |
| 4,132,969 | 1/1979 | Hillyard | 336/94 |
| 4,275,334 | 6/1981 | Beeghly | 315/57 |
| 4,514,712 | 4/1985 | McDougal | 336/96 |
| 4,683,454 | 7/1987 | Vollmer et al. | 335/299 |
| 4,990,881 | 2/1991 | Ooyabu | 336/110 |
| 5,041,807 | 8/1991 | Badaud | 336/92 |
| 5,241,941 | 9/1993 | Hancock et al. | 123/634 |
| 5,349,320 | 9/1994 | Suzuki et al. | 336/92 |

FOREIGN PATENT DOCUMENTS

| | | |
|---|---|---|
| 25106 | 12/1951 | Finland . |
| 2901750 | 7/1980 | Germany . |
| 0105072 | 5/1991 | Japan . |

*Primary Examiner*—Leo P. Picard
*Assistant Examiner*—L. Thomas
*Attorney, Agent, or Firm*—Roger L. May; Richard D. Dixon

[57] ABSTRACT

The present invention discloses an ignition coil assembly comprising a housing of molded plastic material. A coil assembly in the housing includes a primary coil member and a secondary coil member, the secondary coil member includes a high voltage output lead. The housing includes a base wall, and an integral cylindrical stem portion which extends outwardly from the base wall along an axis. A secondary coil output lead terminal member extends in the general direction of the axis through the base wall, and is connected to the high voltage output lead at one end and terminates in a clasp portion at its other end. The clasp portion is received within the annular stem portion. The annular stem portion includes an interior annular wall and an exterior annular wall. The clasp is concentrically located within the stem portion and is spaced therefrom to thereby provide an annular clearance cavity. A coil-type retaining spring is slidingly received at one end within the stem portion and is slidably secured to the clasp portion. The other end of the spring is adapted to grip a spark plug to establish electrical contact between the coil assembly and the spark plug.

13 Claims, 1 Drawing Sheet

IGNITION COIL

TECHNICAL FIELD

This invention relates to ignition coils, particularly coil-per-plug (CPP) type ignition coils for internal combustion engine driven vehicles wherein a single ignition coil unit is provided for each spark plug.

BACKGROUND ART

With recent developments in ignition systems for vehicles, particularly automobiles, electronic ignition systems are now the standard in the industry. With this development, one of the more popular embodiments has been to provide each spark plug, or indirectly each combustion chamber, with its own ignition coil. These are referred to as coil-per-plug (CPP) type ignition coils. Such a design is seen in U.S. Pat. No. 5,241,941, assigned to the assignee of the present invention. The coil housing includes a stem at its bottom end through which projects the secondary coil, or high voltage, output terminal into which, by some means, the electrical output must be passed to the center electrode of the spark plug. Conventionally, a coil spring is used which is in light, non-secured contact with the high voltage output terminal and which lightly snaps over the head of the center electrode of the spark plug. The spring is maintained in place by a concentrically disposed and enclosing rubber boot which is expanded onto the housing output terminal stem at one end and over the spark plug center electrode at the other end to virtually hold the assembly of coil spring in place.

Nevertheless, the electrically conductive coil-type compression spring is not secured to the high voltage output terminal. Rather, it bears against the output terminal under the designed compression of the spring when the coil housing and spark plug are each secured to the engine.

SUMMARY OF THE INVENTION

The present invention contemplates an ignition coil assembly for vehicles of the coil-per-plug type wherein the electrically conductive element, usually a coil-type compression spring, transferring the high voltage output from the secondary coil to the spark plug, is slidably secured to the high voltage output terminal, thereby assuring electrical contact with the high voltage output terminal at all times, and providing for the securing of this conductive element to the coil as part of the subassembly rather than the final assembly of the components on the engine.

The invention further contemplates the high voltage electrically conductive element being a coil-type compression spring and the output terminal being constructed as a clasp, whereby the spring can be secured to the clasp by merely pushing it onto the clasp, the clasp being constructed such that it expands the compression coils at that end of the spring and includes a series of locking ribs for retaining at least one, and preferably two or three, of the individual coils on a respective locking rib on the clasp.

The invention further contemplates an ignition coil assembly having an output terminal as above described wherein the force required to slidably secure the compression spring on the clasp portion of the output terminal is in the order of 4–8 pounds and wherein the retention force is in the order of 7–8 pounds.

The invention further contemplates an ignition coil assembly comprising a housing of molded plastic material. A coil assembly in the housing includes a primary coil member and a secondary coil member, the secondary coil member includes a high voltage output lead. The housing includes a base wall, and an integral cylindrical stem portion which extends outwardly from the base wall along an axis. A secondary coil output lead terminal member extends in the general direction of the axis through said base wall, and is connected to the high voltage output lead at one end and terminates in a clasp portion at its other end. The clasp portion is received within the annular stem portion. The annular stem portion includes an interior annular wall and an exterior annular wall. The clasp is concentrically located within the stem portion and is spaced therefrom to thereby provide an annular clearance cavity. A coil-type retaining spring is slidingly received at one end within the stem portion and is slidably secured to the clasp portion. The other end of the spring is adapted to grip a spark plug to establish electrical contact between the coil assembly and the spark plug.

The invention further contemplates an ignition coil, high output voltage terminal clasp arrangement as above-described for use with other ignition systems that may have a coil spring to transfer high voltage to the spark plug.

The above objects and other objects, features, and advantages of the present invention are readily apparent from the following detailed description of the best mode for carrying out the invention when taken in connection with the accompanying drawings.

BEST MODE FOR CARRYING OUT THE INVENTION

Figure 1:
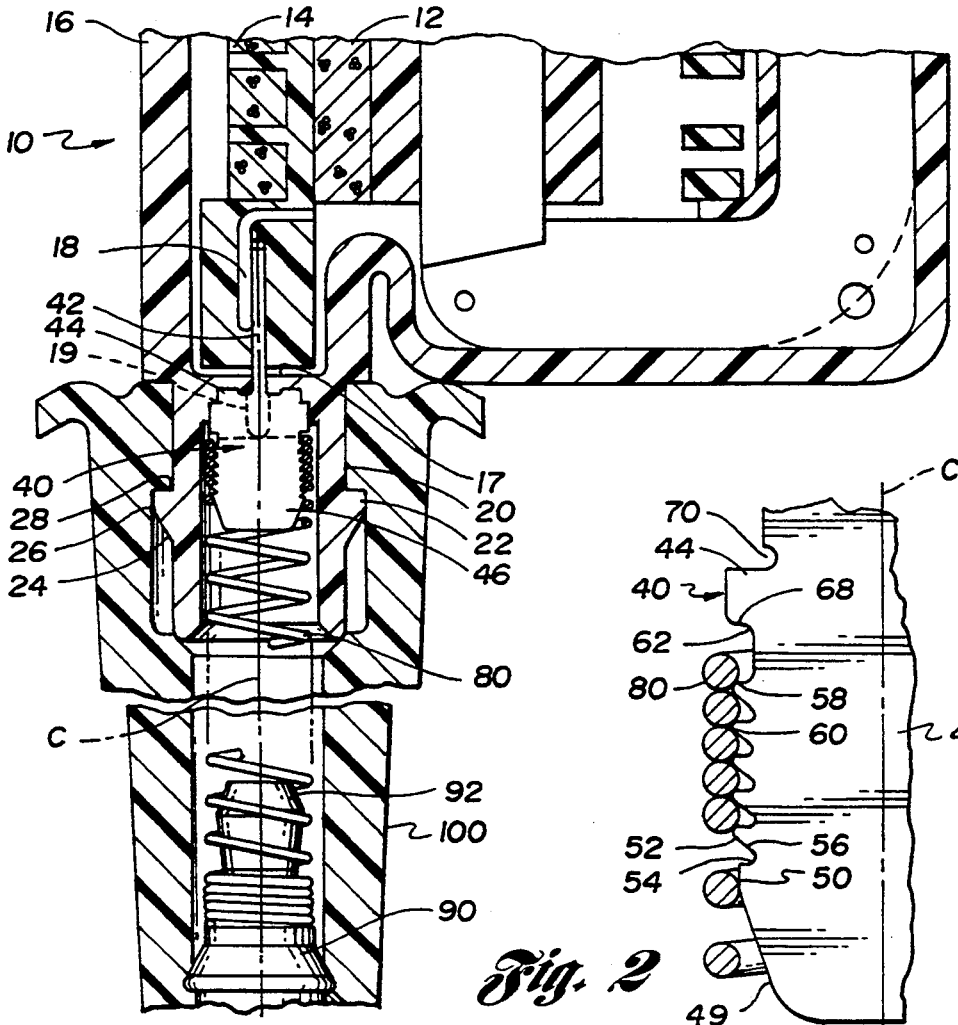
FIG. 1 is an elevation view in partial section of a coil-per-plug ignition coil assembly showing the lower portion of the coil and coil housing in combination with the high voltage output terminal and an electrically conductive compression spring secured to the high voltage output terminal at one end and to the spark plug center electrode at its other end, all in accordance with the present invention.

In FIG. 1, there is shown an ignition coil assembly of the coil-per-plug type generally designated 10 comprising concentrically disposed primary and secondary coils 12,14, respectively, situated within a coil housing 16, only the lower portion of which is shown for purposes of illustrating the present invention. The secondary coil 14 includes a lead 18 in sliding contact with the high voltage output terminal lead 42. Output terminal lead 42 is an integral part of an output terminal member, generally designated 40, constructed in accordance with the present invention.

The housing 16 further includes an outwardly extending cylindrical stem 20. A retaining flange 22 is molded as part of the stem located approximately mid-way of its axial length and projecting radially outward. It serves to expand and sealingly retain a cylindrical rubber boot 100. The front wall 24 of the retaining flange extends radially outward at an acute angle of about 45° to the axis C to provide a ramp for assisting and expanding the rubber boot. It terminates at an annular cylindrical land 26 and thence to a back wall 28 disposed in a plane transverse to the axis of the stem.

The output terminal 40 includes a base or anchor portion 44 molded within the base wall 17 of the housing. The output terminal lead 42 extends from one end of the anchor portion 44 through the base wall 17 and into the housing to make sliding contact with the secondary coil output lead 18 as above-described. Projecting from the other end of the anchor portion into the annular cavity of the housing stem is the clasp portion 46 of the output terminal. It is generally bullet-shaped as seen from the direction of the spark plug 90. It is constructed as a flat metal stamping, preferably brass alloy, having a thickness preferably ranging from about 0.6 mm to about 1.0 mm. It is symmetrical on both sides of the center line or axis C. It includes a nose 48 at its forward end having a width substantially less than the inner diameter of the coil spring 80. The side walls 49 diverge from the nose to a maximum width substantially equal to the inner diameter of the coil spring 80 and terminate at an axial land 50. This land serves to positively center the coil spring on the clasp portion. Serially arranged at the back side of the land 50 is a series of at least one and perhaps as many as five locking ribs 52, each projecting outwardly from the land a predetermined distance sufficient to expand the coil spring an amount necessary to produce the retention force desired.

Figure 2:
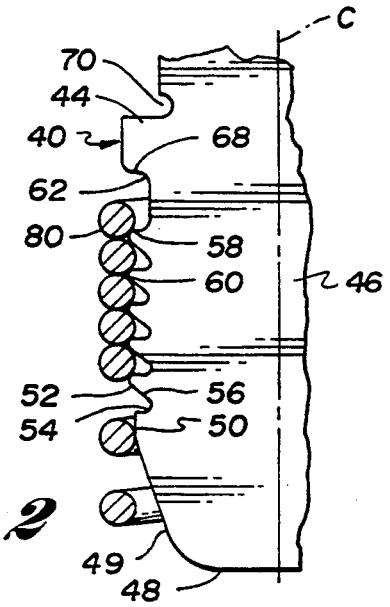
FIG. 2 is an expanded view of the encircled portion FIG. 1 designated A.

As shown in FIG. 2, the ribs are equally spaced and of the same geometric size and shape. Locking grooves 54 are provided between each rib. Each rib 52 includes a front wall 56 inclined at an acute angle of about 45° relative to the axis or center line of the clasp to provide a ramp for somewhat gradual expanding of the coil spring onto the clasp. The back wall 58 of each rib is generally transverse to the axis or center line of the terminal 40 and each rib tip 60 includes a slight radius.

In one preferred embodiment, wherein the brass clasp is about 0.6 mm, the inner diameter of the spring 80 is about 6.50 mm and the width of the clasp across the locking ribs from one side wall to the other is about 6.8 mm, thereby diametrically expanding the coil spring about 0.3 mm. This is sufficient to produce a retention force in the order of 7–8 pounds. This is to be contrasted with the retention force of the spring at its other end on the center electrode spark plug, as below described, which is in the order of less than 0.5 pound. This assures that when the coil assembly is pulled off the spark plug for purposes of replacing the plug, the coil spring will be retained on the coil assembly. If it is necessary to pull the retention spring from the coil assembly, the retention force produced will not destroy the locking capabilities of the output terminal 40. It will also be apparent that due to the construction of the coil spring and clasp, that one could also just simply rotate the spring off of the clasp since the helical coils function as a thread.

Axially rearward of the last locking rib, there is provided a relief portion 62 of reduced width approximately equal to the depth of the locking grooves and extending axially to a locating shoulder 68. The locating shoulder 68 projects transversely from the anchor portion 44. The axial length of the relief portion 62 allows for some assembly tolerance when installing the spring on the clasp.

The shoulder 68 assists in locating the clasp relative to the housing prior to its being molded or otherwise secured within the housing.

Figure 4:
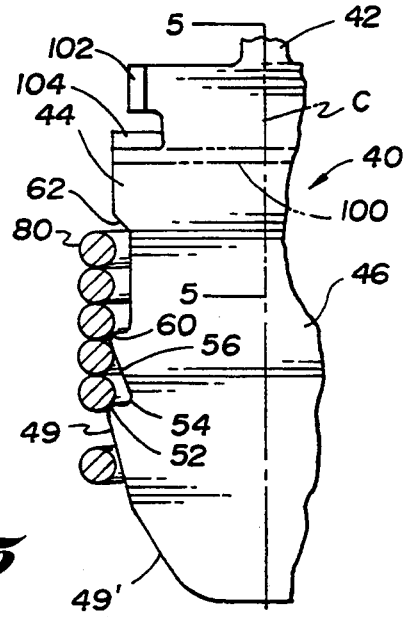
FIG. 4 is also a view similar to FIG. 2 and showing another alternate embodiment of the present invention.

Optionally, the anchor or base portion 44 of the clasp may include an undercut 70 as shown only in FIGS. 2 and 4 to improve axial retention of the output terminal within the housing.

At the opposite end of the spring 80, the spring is held in light contact with the upper portion 92 of the spark plug center electrode which is received within the conventional porcelain insulator 94. The end 82 of the spring abuts against the shoulder 96 of the center electrode upper portion 92.

The cylindrical rubber boot 100 is sealingly secured to the stem portion of the coil housing as above-described, loosely surrounds the coil spring 80, and is expanded upon and sealingly secured to the spark plug 90 in known manner.

It will be noted from FIG. 1 that the clasp portion of the output terminal 40 projects axially about mid-way of the stem, and approximately opposite the boot-retaining flange 22. The clearance between the inner diameter of the stem and the side walls of the clasp is no more than necessary to allow ingress and egress of the coil spring 80 and its slight expansion upon the clasp 46.

Figure 3:
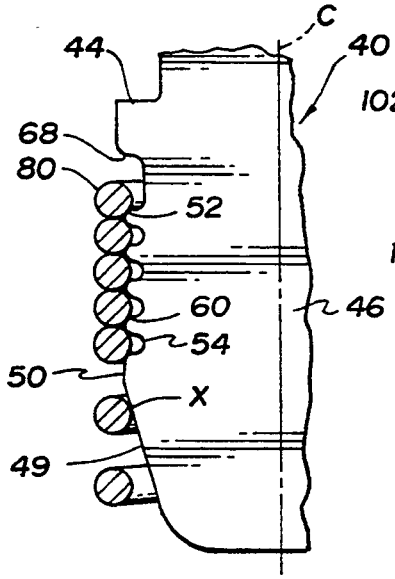
FIG. 3 is the same view as FIG. 2 but showing an alternate embodiment of the present invention.

In FIG. 3, there is shown an alternate embodiment of the clasp portion of the output terminal 40. This embodiment differs only in the design of the locking ribs 52 and grooves 54, and in that the land 50 off of the nose portion is of a width equal to that of the tip of the ribs and sufficient to expand the coil spring the amount desired, as above-described. Thus, at point E, as seen in FIG. 3, the front expanded diameter of the coil spring makes contact with the diverging side wall 49 and from that point axially rearward is expanded as the coil spring is pushed on over the ribs 52. As assembled, the tip 60 of each rib will engage a respective coil as with the embodiment of FIG. 2.

Similarly, the spacing between the tips of the ribs is sufficient to allow each coil to partially reside within the locking groove 56, whereby the retention force is substantially greater than the force required to push the spring onto the clasp. In all other respects, the design as shown in FIG. 3 is the same as that shown in FIG. 2.

FIG. 4 shows another embodiment of the present invention, differing from the other embodiments in the manner in which the locking ribs and grooves are shaped, and the fact that the leading rib 52 also constitutes the land 50 of the previous embodiments, and the manner in which the anchor portion is constructed to provide retention arms 102,104. As with the embodiment of FIG. 2, each rib 52 is ramped, i.e. includes a front wall 56 inclined at about 45° to axis C. Unlike the previous embodiments, the number of ribs is preferably reduced to two, with the spacing between the ribs being approximately equal in axial length to the axial length of two coils. Thus, two coils will partially reside within each locking groove, rather than just one.

This also results in being able to provide an extended relief portion 62, thereby allowing greater assembly tolerance when installing the spring onto the clasp.

Further, the side wall 49 diverges at a dual angle so that the side wall portion 49 is inclined at a greater angle to thereby allow a decrease in the overall length of the clasp portion 46. The remaining portion of side wall 49 forms the front wall 56 of the lead rib 52.

Figure 5:
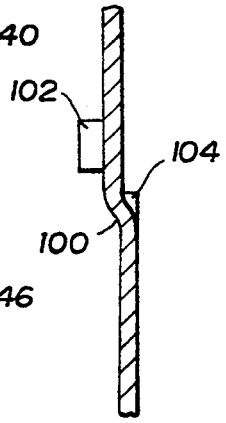
FIG. 5 is a cross-sectional view taken along lines 5—5 of FIG. 4 showing the clasp anchor portion including the off-set arms which assist in locating and anchoring the clasp within the housing.

Further, as seen in FIGS. 4 and 5, the anchor portion 44 is offset by an amount equalling the thickness of the output terminal along a fold line 100. Also, the anchor portion is undercut to provide retaining arms 102,104. Retaining arm 102 is bent 90° to extend transversely of the normal plane of the output terminal, whereas retaining arm 104 is not folded along fold line 100 to thus provide a vertically extending offset retaining arm.

With each embodiment, the manner of assembling the coil assembly is the same. The coil spring is slidably inserted over the clasp portion 46 of the output terminal 40. As shown in FIG. 1, the spring travel into the stem 20 is arrested by a pair of diametrically opposed ribs 19 (one of which is shown in hidden line) molded as part of the stem at locations 90° offset from the normal plane of the output terminal member 40. Thereafter, the rubber boot 100 is slid onto the housing stem 20 past the retaining flange 22 to a point of preferably abutting the bottom wall of the housing. This subassembly is therefore ready to be placed as an integral assembly onto the engine and connected to and over the spark plug center electrode 92.

The compression coil spring 80 is preferably of the type where the coils at each end are closed for at least the first 3–6 coils and wherein the coils in the mid-portion of the spring are expanded to allow for adjustment of the position between the spark plug and the coil housing as each is assembled on the engine. In the specific embodiment described above, the diameter of each coil is about 0.635 mm in cross-sectional diameter.

While the best mode for carrying out the invention has been described in detail, those familiar with the art to which this invention relates will recognize various alternative designs and embodiments for practicing the invention as defined by the following claims.

We claim:

1. An ignition coil assembly comprising:

a housing of molded plastic material;

a coil assembly within said housing and including a primary coil member and a secondary coil member;

said secondary coil member including a high voltage output lead;

said housing including a base wall, and an integral cylindrical stem portion extending outwardly from said base wall along an axis, a secondary coil output lead terminal member extending generally in the direction of said axis through said base wall, and being connected to said high voltage output lead at one end and terminating in a clasp portion at its other end, said clasp portion being received within said annular stem portion;

said annular stem portion including an interior annular wall and an exterior annular wall;

said clasp being concentrically located within said stem portion and spaced therefrom to thereby provide an annular clearance cavity; and a coil-type retaining spring slidingly received at one end within said stem portion and slidably secured to said clasp portion, the other end of said spring being adapted to engage a spark plug to thereby establish electrical contact between said coil assembly and the spark plug.

2. The invention as claimed in claim 1 further including an annular, flexible, electrically non-conductive boot member slidingly received onto said housing stem portion exterior annular wall at one end and adapted to receive and hold in place the spark plug at its other end, said retaining spring being loosely received within said boot member.

3. The invention as claimed in claim 2 wherein said clasp portion includes a plurality of oppositely disposed, spaced retaining ribs projecting radially outwardly therefrom a distance greater than the inside diameter of said coiled retaining spring, thereby maintaining the spring coils in radial compression at the ribs, and thus securing the spring to the secondary coil output lead terminal member and assuring a high voltage connection between the secondary coil and the spark plug.

4. The invention as claimed in claim 3 wherein said output lead terminal member is a flat sheet readily adaptable to be stamped to final shape.

5. The invention as claimed in claim 4 wherein said output lead terminal member is made of brass alloy.

6. The invention as claimed in claim 3 wherein said clasp portion is bullet-shaped having a nose portion of reduced width less than that of said retaining spring, a pair of side walls diverging from said nose portion and respectively terminating at a land of an established axial length, the width of the clasp portion across said lands being slightly greater than the unexpanded inner diameter of said retaining spring whereby as the spring is slidably installed upon the clasp portion, the coils at said one end of the spring are expanded.

7. The invention as claimed in claim 6 wherein said retaining ribs are adjacent said land opposite said diverging walls, said ribs at the tip thereof projecting outwardly of the respective land to thereby further expand the one end of said coiled retaining spring.

8. The invention as claimed in claim 7 wherein there is provided a locking groove between each of said ribs, said ribs being axially spaced from one another a distance approximately equal to the cross-sectional diameter of each coil, whereby each coil is impinged upon a respective rib and is at least partially seated within a respective locking groove.

9. The invention as claimed in claim 7 wherein there is provided a locking groove between each of said ribs, said ribs being axially spaced from one another a distance approximately equal to at least twice the cross-sectional diameter of each coil, whereby at least every other coil is impinged upon a respective rib and is at least partially seated within a respective locking groove.

10. The invention as claimed in claim 8 wherein each rib includes a front wall facing said nose portion and a back wall facing said housing; and said front wall diverging outwardly at an acute included angle relative to the center line of said clasp portion, thereby assisting in spreading the coils of the spring as it is slidably installed upon the clasp portion.

11. The invention as claimed in claim 9 wherein each rib includes a front wall facing said nose portion and a back wall facing said housing; and said front wall diverging outwardly at an acute included angle relative to the center line of said clasp portion, thereby assisting in spreading the coils of the spring as it is slidably installed upon the clasp portion.

12. The invention as claimed in claim 6 wherein said output lead terminal member further includes an anchor portion molded within the base wall of said housing;

said anchor portion being of a width substantially equal to the width of the clasp portion, and including an undercut whereby the molded housing base wall will anchor the base portion in place.

13. The invention as claimed in claim 6 wherein said output lead terminal member further includes an anchor portion molded within the base wall of said housing;

said anchor portion being of a width substantially equal to the width of the clasp portion, and including retention means comprising at least one retainer arm projecting transversely from the normal plane of said anchor portion and at least one retainer arm projecting parallel and offset from the normal plane of said anchor portion.

* * * * *